US007011123B2

(12) United States Patent
Peterson

(10) Patent No.: US 7,011,123 B2
(45) Date of Patent: Mar. 14, 2006

(54) BLOCK HOIST

(76) Inventor: Byron Peterson, 381 Vautier Rd., Sequim, WA (US) 98382

( * ) Notice: Subject to any disclaimer, the term of this patent is extended or adjusted under 35 U.S.C. 154(b) by 0 days.

(21) Appl. No.: 11/018,769

(22) Filed: Dec. 20, 2004

(65) Prior Publication Data

US 2005/0133114 A1 Jun. 23, 2005

Related U.S. Application Data

(60) Provisional application No. 60/531,701, filed on Dec. 22, 2003.

(51) Int. Cl.
*B27L 7/00* (2006.01)

(52) U.S. Cl. ..... 144/195.1; 144/193.1; 144/366; 144/4.6

(58) Field of Classification Search ..... 144/193.1, 144/195.1, 195.7, 366, 4.6; 414/744.3
See application file for complete search history.

(56) References Cited

U.S. PATENT DOCUMENTS 508,221 A * 11/1893 Hil ..... 144/195.1
2,851,072 A * 9/1958 Gerjets et al. ..... 144/193.1
3,410,420 A * 11/1968 Butts ..... 414/23
4,155,385 A * 5/1979 Lapointe ..... 144/195.1
4,284,112 A * 8/1981 Hoskin ..... 144/4.6
4,351,378 A * 9/1982 Smith ..... 144/195.1
4,483,379 A * 11/1984 Aikins et al. ..... 144/366
4,487,239 A * 12/1984 Anderson ..... 144/195.1
D281,113 S 10/1985 Plumb
4,559,985 A * 12/1985 May ..... 144/195.1
4,700,759 A * 10/1987 Duerr ..... 144/195.1
4,770,218 A * 9/1988 Duerr ..... 144/195.1
5,520,498 A 5/1996 DiBartolomeo
5,575,517 A 11/1996 Thomas
5,622,237 A 4/1997 Moldow
5,651,404 A * 7/1997 Kraemer et al. ..... 144/195.1
5,820,455 A 10/1998 Breedlove
5,967,206 A * 10/1999 Milton ..... 144/195.1
6,095,349 A 8/2000 O'Meara
6,371,449 B1 4/2002 Chamberlain

FOREIGN PATENT DOCUMENTS

EP 51853 A1 * 5/1982

OTHER PUBLICATIONS

Country Home Products, Vergennes, Vermont, Winter 2004 catalog p. 22, 23: Wood Splitters and accesories.

(Continued)

*Primary Examiner*—Bena Miller
(74) *Attorney, Agent, or Firm*—Innovation Law Group, Ltd.; Jacques M. Dulin, Esq.

(57) ABSTRACT

A new or retrofit block hoist for conventional, hydraulic-powered log splitters assists in the lifting, maneuvering, and positioning of large diameter, heavy logs that require multiple radial splits to section them for firewood, comprising a boom, pulley and cable system. A boom assembly is secured to the top end of the splitter guide beam and pulleys guide a lifting cable anchored to the wedge slide to a log section retainer means (dog or awl). The upward, hydraulically-powered movement of the cutting wedge along the I-beam lifts the log section as the wedge is raised into its upward, retracted position. Once lifted, the log is swung into position between the wedge and splitter foot plate. The wedge is then power extended (lowered), splitting the log. An optional turntable is securable to the footplate. The inventive block hoist can be provided as a kit.

17 Claims, 8 Drawing Sheets

OTHER PUBLICATIONS

RS-Q Hoist (formerly Uni-Hoist) Hoists masts, sleeves, mounts and other accessories from the web site of Canadian Safety Equipment Inc. Mississauga Ontario, CA L5A 3P2, Apr., 2002.

Halliday Products Portable Hoists, specification sheet.

24-Ton Horizontal and Vertical Log Splitter from FortheFarm.com, Aug., 2002.

Troy-Bilt 27 ton Log Splitter, described on web site.

* cited by examiner

BLOCK HOIST

CROSS REFERENCE TO RELATED APPLICATION

This is the Regular U.S. Patent Application of prior Provisional Application Ser. No. 60/531,701 filed Dec. 22, 2003 by the same inventor under the same title, priority of which is hereby claimed under 35 U.S. Code Section 119, 120ff, and the disclosure of which is hereby incorporated by reference.

FIELD

The invention relates to log splitting systems, and more particularly to block hoists for conventional hydraulic ram-powered log splitters for ease and effectiveness of lifting and positioning of logs for splitting. The inventive block hoist is of particular use in splitting large, heavy logs of a large diameter, and it may be used with new splitters or retrofitted on splitters already in use.

BACKGROUND

There are a variety of hydraulic ram log splitting systems for commercial and non-commercial use that have been developed in the past few decades. Initially, splitters used an engine driven pump that produced less than 1000 psi. Current units utilize more powerful hydraulics, which produce 2000–3000 psi, equivalent to 15–25 ton splitters.

Current models feature hydraulic power systems in which a hydraulic cylinder (with valve and short hoses) is mounted to an I-beam. The hydraulic splitters may be positioned horizontally or vertically. For the more usual vertical, downward splitting type, the log blocks must be manually picked up and placed into position on a foot plate, and an angled wedge is hydraulically driven by the ram (piston) downwardly into the log to effect the splitting. Some hydraulic splitters are positioned horizontally in which case the logs are lifted onto the I-beam and positioned between an angled wedge and a block support. In some systems, the block support moves and pushes the log against a wedge; in other systems, the wedge is hydraulically powered and it moves against the log retained by the block support. Current hydraulic log splitters are usually mounted on a chassis to be transportable.

Typically, the hydraulic cylinder is a standard 3"×18" stroke ram cylinder designed for at least 1500 psi working pressure. The control valve may be a standard 4-way, 3 position, double acting, open-center type, with ½" national pipe thread ports. The valve spool is typically spring biased and self-centering. A self-releasing detent is provided for the return position and has an integral relief valve set at about 1500 psi. All structural parts of the units are welded. Hydraulic power for the pump unit can be supplied by a tractor, PTO, gasoline engine or electric motor.

By way of example, conventional log splitters comprise a hydraulic ram terminating in a splitting wedge that is guided to slide on one flat flange face of an I-beam. Oriented vertically or horizontally, some include horizontal transverse hinges of axle members (rods) at the back of the I-beam to pivot from the vertical or horizontal. Some include power means to assist lifting blocks into place.

Conventional hydraulic splitters are designed to split logs of 8 to 12 inches in diameter. Most logs fall into this size category. Larger logs up to about 30–40" in diameter can be split using these units; however they pose several problems given their weight and dimensions.

First, moving larger, heavier logs toward the splitter and into close proximity with the hydraulic cylinder and wedge is difficult, particularly if there is only one person using the unit. The logs are moved into position by hand, usually by sliding or rolling along the ground. If the log has to be moved on the ground, one or more sides of the log may become covered in dirt or mud which makes the resulting firewood undesirable for indoor handling.

Second, large logs (i.e., from 12 up to 40 inches in diameter) are difficult to position on the foot plate of a vertically-oriented hydraulic unit, as the foot plate is sized for placement of logs of approximately 10" in diameter. The position and dimensions of the foot plate correspond to the position of the hydraulically-lowered wedge for optimal cutting. Logs of a larger diameter tip at an angle when slid or placed on a typical foot plate since the foot plate is small, is welded to the I-beam, and is a few inches off the ground. As a result, the larger log cannot be centered over the foot plate. If the log is tipped at an angle when resting on the foot plate, the hydraulically-powered wedge will contact the log at an angle resulting in uneven and unpredictable splits in the log, which can be dangerous.

Third, large logs are difficult to manipulate once the splitting has commenced. Splitting of smaller logs 6" to 12" in diameter occurs across the full diameter. However, with large logs only a radius or partial radius can be split. After the initial radial split in the log, it is usually only fractured; no wood piece has yet been removed. The log must be lifted/slid and rotated by hand to a desired position for the next radial split. This maneuvering by hand of a heavy, partially split or fractured log is time consuming and often requires that the larger log be completely rotated out of position off of the foot plate and re-positioned back onto the foot plate.

In sum, even with the advantages of a hydraulic splitting unit, such units are not designed to handle large logs. Splitting large logs requires significant back and arm strength, and time-consuming effort in: (1) moving the large log into close proximity of the hydraulic wedge; (2) lifting and positioning the larger log onto the foot plate beneath the wedge for radial splitting; and, (3) rotating and re-positioning the log onto the foot plate for each subsequent radial split so that the log is eventually sectioned into multiple wedges along intersecting radial lines.

Accordingly, there is a significant, unmet need in the field for an improved hydraulic-powered log splitting unit having a log lifting and positioning system that permits the splitter to be more easily, speedily, and effectively used to handle heavy logs of larger dimension.

THE INVENTION

Summary of the Invention, Including Objects and Advantages

The invention comprises a block hoist system fit onto conventional hydraulic splitter units to assist in the lifting, maneuvering, and positioning of large logs that require multiple radial splits to section them for firewood. In a first embodiment, the block hoist comprises a lifting cable and pulley system cooperatively linking the upward, hydraulically-powered movement of the ram and splitting wedge with the lifting of a log section connected to the lift cable by an auger or dog and an adjustable chain. The dog (or other securing device) is pounded securely into the log section, preferably near the center, and attached by an adjustable chain section to the cable and pulley system. As the hydraulically-powered ram and wedge is raised into its upward position (at the commencement of splitting and between splits), the inventive cable and pulley system fitted to the unit's I-beam guide structure lift the chain and auger, thereby pulling and lifting the log. Once the log is partially or fully lifted, the person operating the unit may easily swing the log into position between the wedge and foot plate and rotate the log, as needed, between splits.

The pulley system comprises a boom secured to the top end of the guide beam on which the wedge is slidingly mounted to reciprocate from a first, raised or retracted position to a second, lowered or extended position. At least one and preferably two pulleys are secured to the boom to guide the cable up and back to the rear (lower) flange on the guide beam. Another pulley is secured adjacent the foot end of the guide beam. An anchor assembly or anchor point is on the movable wedge. The cable is anchored to the wedge, passes to the pulley at the foot end; thence upwardly to the rear-boom pulley and to the forward boom pulley and down, where it terminates in a loop or ring to which the dog-chain is hooked. The opposite end of the chain carries the dog, auger or other log section securing device.

In a second embodiment of the invention, the foot plate of the hydraulic unit is modified for handling large logs by addition of a turntable. The turntable comprises a circular disc attached by a center pin or axle to an extension sheath that slides over (or under or around) the foot plate and is retained by it. The lifted log section is placed on the turntable and simply rotated between radial splits as opposed to having to re-lift and re-position the log. Optionally, a handle connected to the disc is provided to assist in rotating the disc between splits.

By way of example only, the inventive block hoist embodiments are described in more detail below.

BRIEF DESCRIPTION OF THE DRAWINGS

The invention is described in detail by reference to the following photographs and drawings:

FIG. 7*a* is an isometric drawing of the boom assembly, showing the forward pulley bracket assembly in exploded view.

DESCRIPTION OF THE INVENTION, INCLUDING THE BEST MODE

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

The Figures are numbered and annotated so that one skilled in the art of block hoist use and construction, by reference to the attached parts list will easily be able to understand the materials and method of construction and will be able to easily assemble the parts to achieve the functionality shown.

Figure 1:
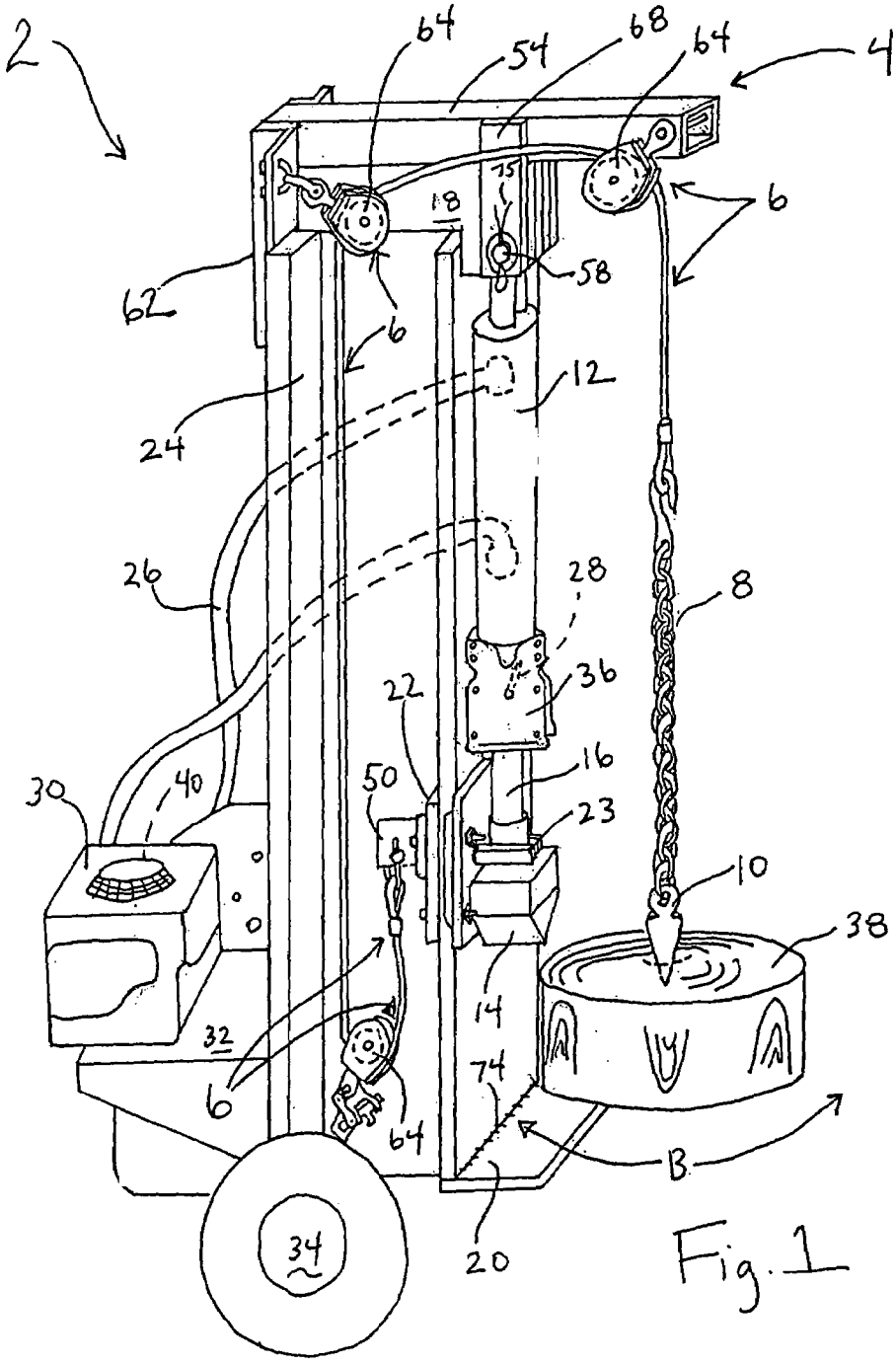
FIG. 1 is a ¾ side elevation view showing the hydraulic-powered wood splitting unit from the left front side, fitted with the inventive block hoist, including a boom assembly at the top of the hydraulic cylinder, and a cable and pulley system with a hanging, adjustable chain and auger/spike.

Referring to FIG. 1, the inventive block hoist 2 (which is fitted onto the existing hydraulic-powered unit described above) comprises: (1) a bracket/boom assembly 4 fitted to the hydraulic mounting block 18 (described below in detail in reference to FIG. 2); and, (2) a cable and pulley system 6 with adjustable chain 8 and auger or dog 10 (described below in detail in reference to FIGS. 2 and 3).

FIG. 1 shows the left side of a hydraulic-powered wood splitting unit in the vertical position and fitted with the inventive block hoist assembly 2. The hydraulic-powered unit comprises a hydraulic cylinder 12 having a piston rod (ram) 16 to which a splitting wedge 14 is attached. A typical hydraulic cylinder 12 has two opposed sheaths 36 at its base.

The hydraulic cylinder 12 is held in position at its top end by attachment of the cylinder 12 to a mounting block 18, which in turn is welded to the head or top end of an I-beam-type guide beam 24. A pin 58 passing through aligned holes in boom pin plates 68, mounting plates 78 (see FIG. 7*b*) and hydraulic mounting block 18 retains the hydraulic cylinder 12.

The I-beam 24 terminated at its foot or lower end in a horizontal foot plate 20. The foot plate 20 may be welded at 74 to the end of the beam 24. The I-beam 24 and foot plate 20 also are supported by attachment to a chassis 32. A gas engine 30 is attached to the chassis 32 to power a hydraulic fluid pump 40 linked by hoses 26 to the hydraulic cylinder 12. The chassis 32 has wheels 34 to assist in transportation of the unit. The control valve handle 28 opens the valve to operate the hydraulics and move the piston rod 16 and attached splitter wedge 14 up or down.

In operation, the hydraulically-powered piston rod 16 and attached wedge 14 are hydraulically reciprocatingly driven upward and downward to effect splits in log sections resting on the foot plate 20. The splitter wedge 14 is guided and retained during its upward and downward movement by a wedge slide 22 bolted to the I-beam 24. (See FIGS. 3*a* and 3*b*).

The boom assembly 4 is shown at the top of the hydraulic mounting block 18, and the forward boom pulley 64 in the cable pulley system 6 is shown with adjustable chain 8 and auger 10 hanging from the end of the cable 66.

During operation of the inventive block hoist, when the wedge 14 is hydraulically raised to an upper or retracted position, the wedge slide 22 moves upwards thereby pulling upwards the end of cable 66 that is attached or anchored at 50 to the wedge slide 22. As the cable 66 is pulled upwards, the attached chain 8, auger 10 and block 38 also rise.

When the wedge 14 is hydraulically lowered, the wedge slide 22 moves downward, thereby lowering the end of the cable 66. The weight of the chain 8 (or/and block 38) attached to the other end of the cable 66 provides tension on the cable 66. As the cable 66 end attached to the wedge slide 22 is lowered, the chain 8, auger 10, and log section 38 also are lowered.

To operate the inventive block hoist, the person(s) splitting logs would: (1) hydraulically lower the wedge 14 (by manual lowering of the control valve handle 28 (see FIG. 1) to the desired point where there is sufficient slack in the cable 66 and chain 8 to reach the center of a log section 38; (2) pound the dog 10 into the center of the log section; (3) hydraulically lift the wedge 14 (by manual operation of the control valve handle 28) until the log section is elevated; (4) swing (along log arc B) the log section 38 into position over the foot plate 20; (5) hydraulically lower the wedge 14 to rest the log 38 on the foot plate 20, and continue lowering to effect a split. As the wedge 14 is lowered, the log section will be lowered, until the log section is resting on the foot plate 20, at which time the wedge 14 will effect a radial split. Steps 3 through 5 may be repeated for subsequent radial splits of the same log. Each time the wedge 14 is raised, the log section 38 or block is elevated and can be easily rotated and positioned for the subsequent radial split to produce split wood wedges.

Figure 2:
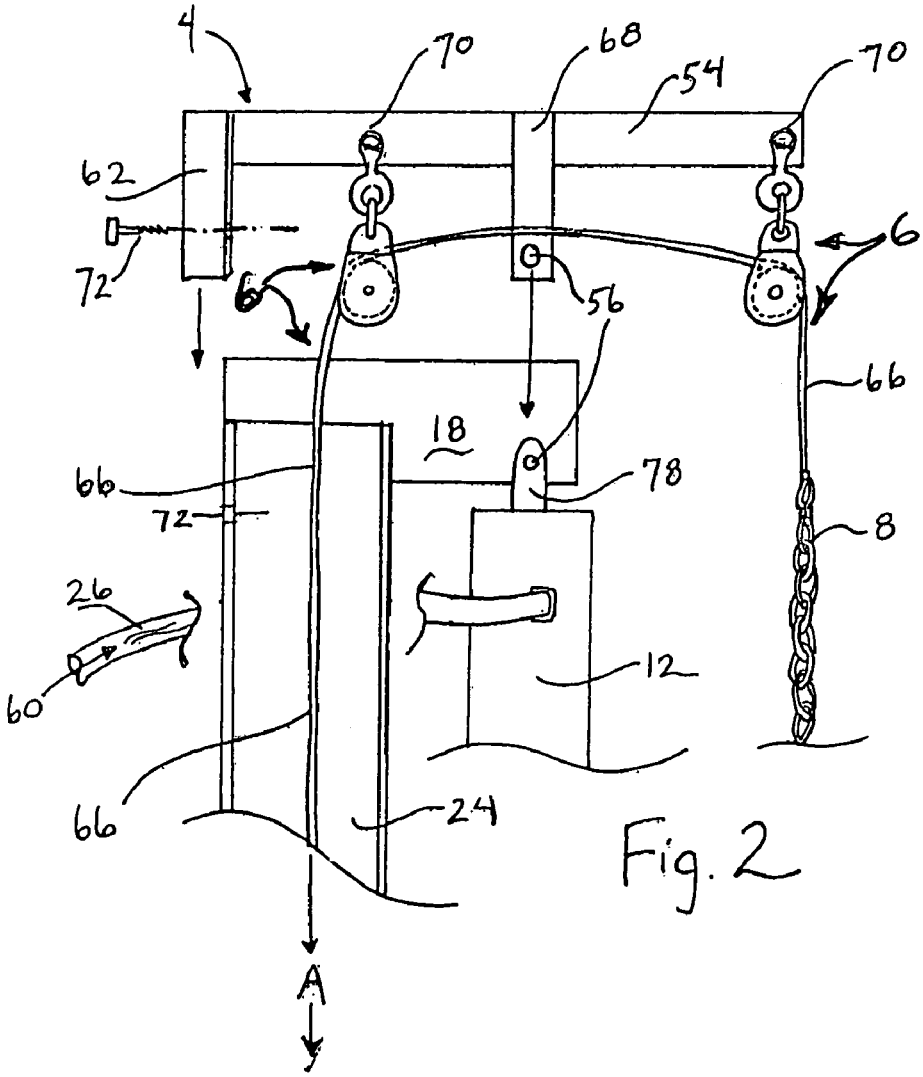
FIG. 2 is a side elevation line drawing of the upper boom assembly of the inventive log hoist, showing the boom hoist cable and pulley system mounted atop the I-beam structure.
Figure 3A:
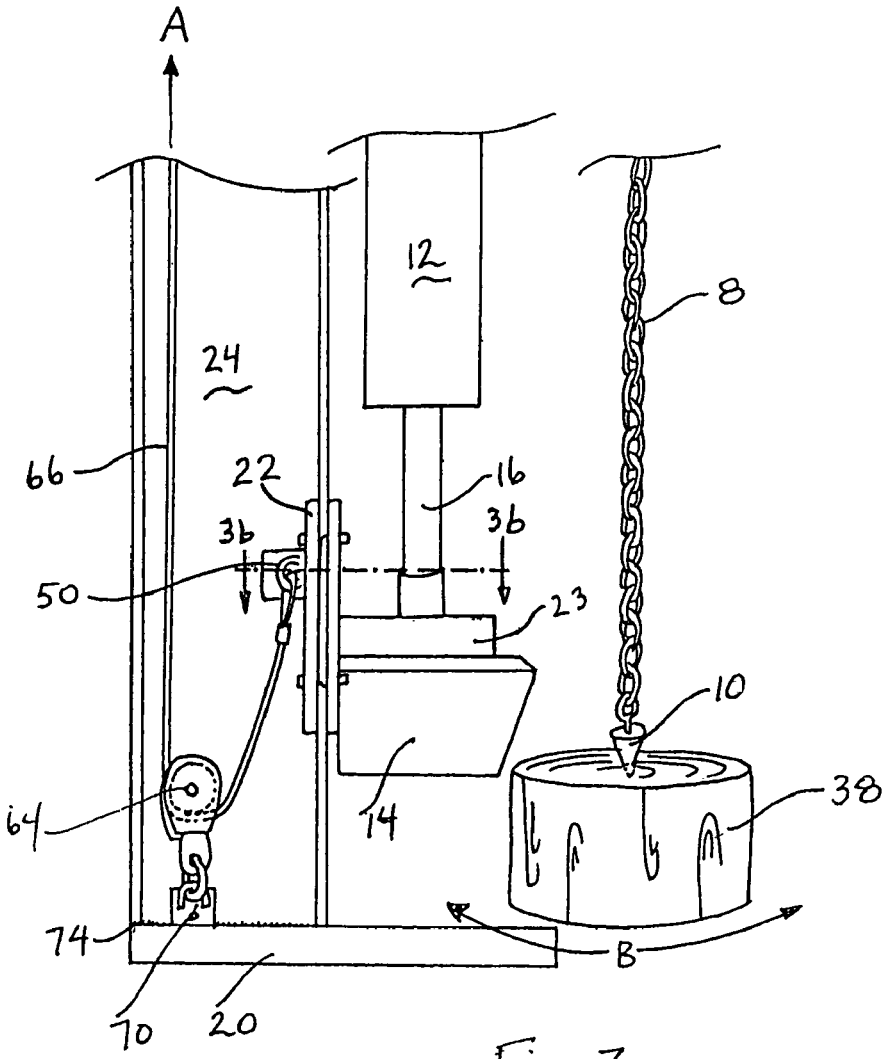
FIG. 3*a* is a side elevation line drawing of the lower/bottom of the splitter showing the inventive hoist cable and pulley system attached to the footplate and the wedge slide, and showing how the wood log is secured by the hoist chain and auger.

FIG. 2 shows the upper boom/bracket assembly 4 which slides down over the hydraulic mounting block 18. This is seen in isometric in FIGS. 4 and 7*a*. Referring to FIG. 2, the bracket assembly 4 comprises vertically-oriented, spaced angle irons 62 and vertically-oriented, spaced boom pin plates 68, welded to a horizontally-oriented square iron tube 54 (only the left side angle iron 62 and boom pin plate 68 is visible in FIG. 2). The bracket assembly 4 is mounted to the top of the hydraulic mounting block 18 and retained by: (1) bolts 72 through the angle irons 62 and the rear flange of the I-beam 24; and, (2) a pin 58 inserted and securely fastened through holes 56 in the opposed boom pin plates 68, corresponding holes in opposed cylinder mounting plates 78 and a corresponding hole in the hydraulic cylinder block 18. Two spaced pulleys 64 (one forward and one in the back) are attached to the bracket assembly 4 by pulley brackets or offsets 70. Cable 66 is pulled through the pulleys 64 and downward by the weight of the adjustable chain 8 along path A, which continues into FIG. 3;

FIG. 3*a* shows the lower part of the inventive hoist cable and pulley system. The terminal end of the cable 66 is attached to the wedge slide 22 by a cable bracket/anchor assembly 50. The cable 66 runs downward through a pulley 64 attached to the foot plate 20 by a pulley bracket 70. The cable 66 then runs upward (along path A) to the rear boom pulley 64 attached to the boom assembly 4 (in FIG. 2). The cable can be anchored to slide 22 simply by drilling a hole in the slide or bracket. A dog or other securing member 10 is inserted (pounded or screwed) into the center of a log section 38. The log section 38 may then be lifted by the chain 8. More than one chain 8 and dog 10 (e.g., 3 spaced dogs) may be used to help keep the log section level, steady and correctly positioned during the splitting process.

Figure 3B:
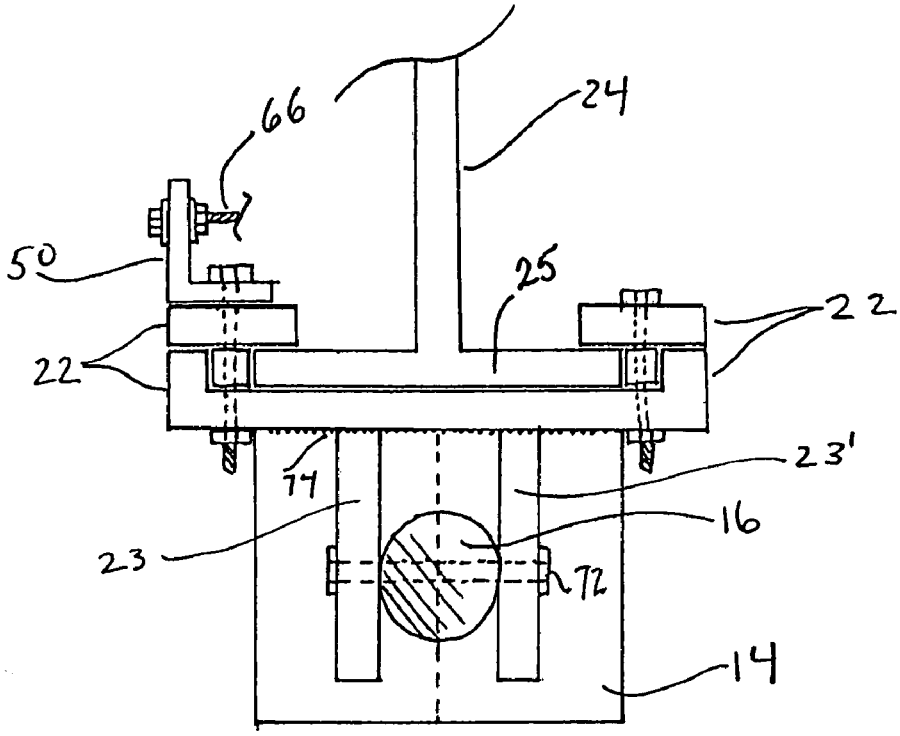
FIG. 3*b* is a section drawing showing how the slide plate assembly attaches to the I-beam and the hydraulic cylinder.

FIG. 3*b* shows a cross-section along lines 3*b*-3*b* in FIG. 3*a*, to illustrate how the wedge slide plate assembly 22 is bolted around the forward flange 25 of the guide beam 24. Welded onto the face plate of the slider assembly 22 are two metal brackets 23, 23' to which the piston rod 16 is secured by bolt 72. Thus, when the hydraulic cylinder 12 moves upward, the slider assembly, to which is attached the cable 66 and bracket 50 also moves upward, pulling the cable 66 and elevating the log section 38, which is attached to the cable via a chain 8 and an auger 10.

Figure 4:
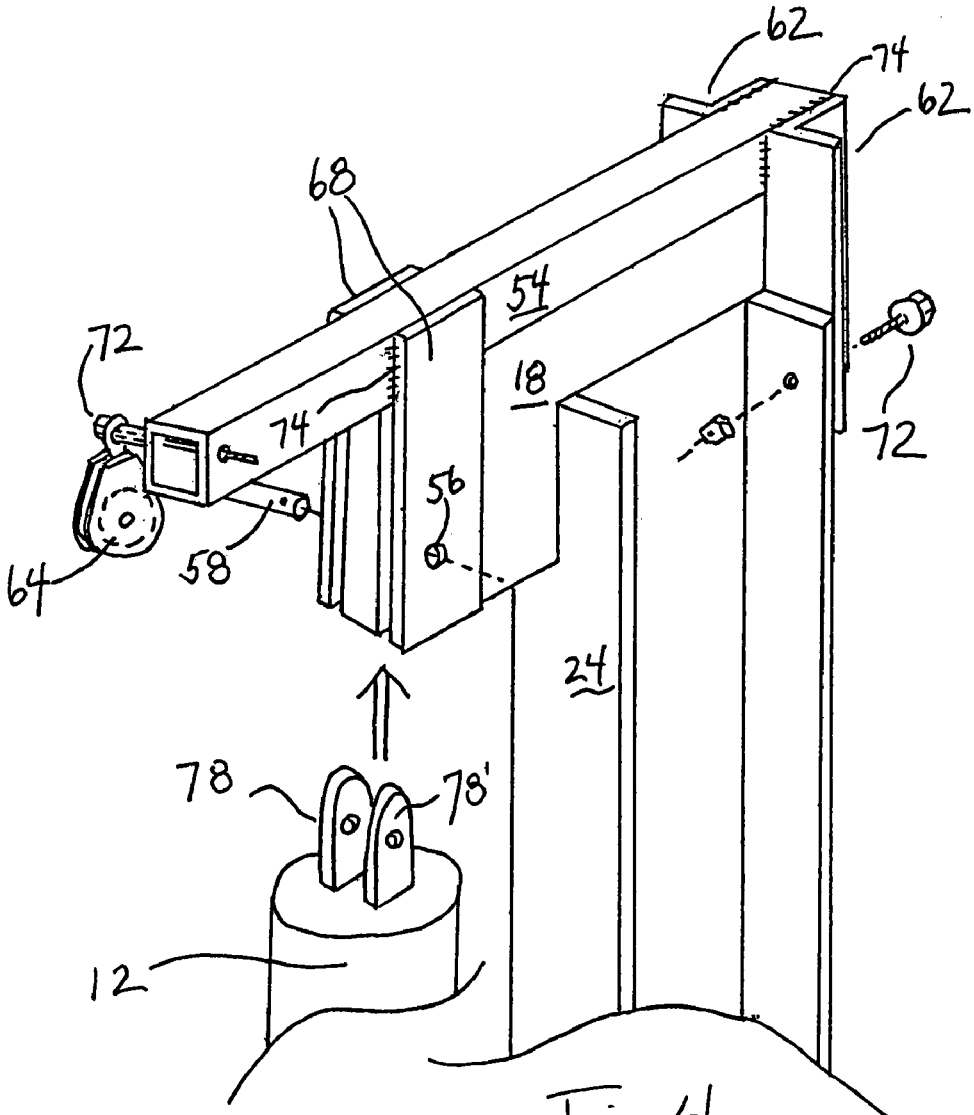
FIG. 4 is an isometric line drawing of the boom and bracket assembly that fits over and attaches to the I-beam for retaining one or more upper boom pulleys.

FIG. 4 shows the boom/bracket assembly 4 mounted to the top of the I-beam type guide beam 24 via hydraulic mounting block 18. Each angle iron 62 is attached by a bolt 72 to the rear flange of the I-beam 24. The angle irons 62 are welded 74 to the square boom tube 54. The opposed boom pin plates 68 also are welded 74 to the square tube 54. The pin 58 is inserted through holes 56 in the boom pin plates 68, cylinder mounting plates 78, 78' and the hydraulic mounting block 18.

Figure 5A:
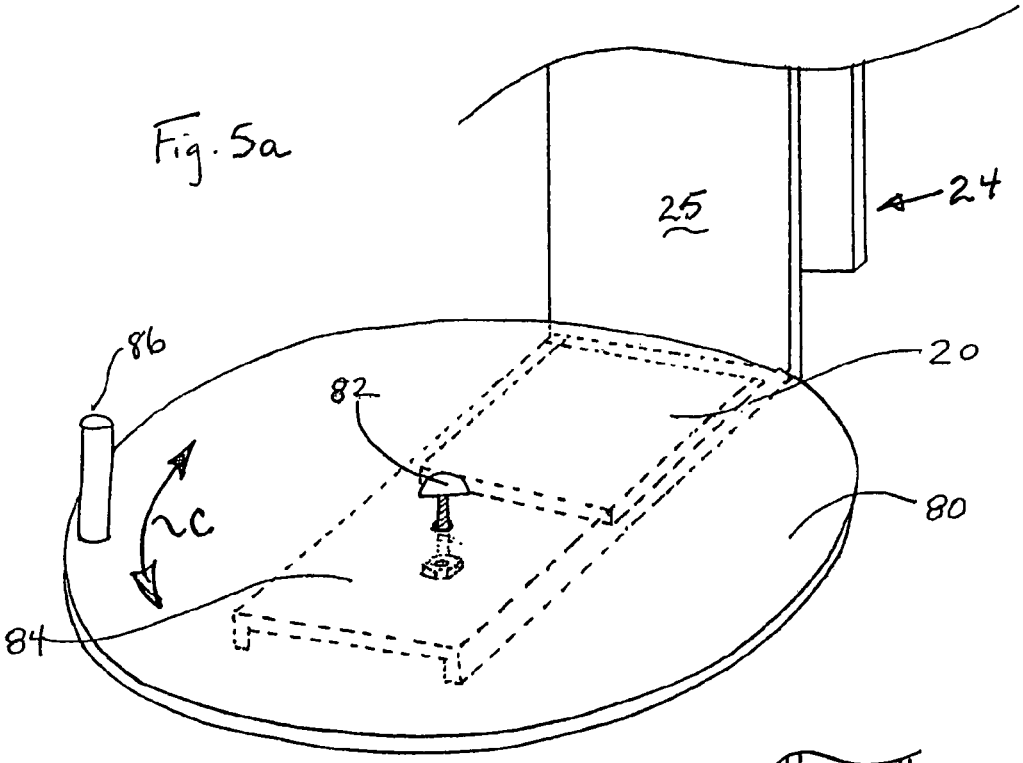
FIG. 5*a* is an isometric view of an embodiment of a rotatable turntable that fits over the foot place, for rotating a larger log placed on the turntable for multiple splits by the hydraulic splitter.
Figure 5B:
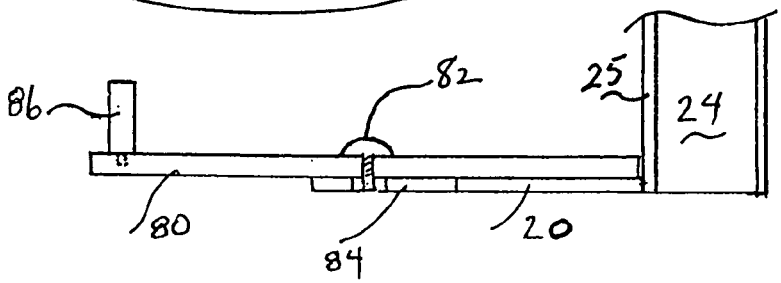
FIG. 5*b* is a side view (partly in section) showing how the assembly attaches to the footplate.

FIGS. 5*a* and 5*b* show an exemplary embodiment of a rotatable turntable 80 slid over the foot plate 20 for rotating larger logs needing multiple radial splits. The turntable 80 is disc-shaped with sufficient strength and diameter to support large log sections. The turntable 80 rotates on a pivot pin 82 (e.g. a bolt) attaching the turntable 80 to an underlying extension 84. The extension sheath 84, conveniently comprises, for example, an inverted section of channel, and extends to the base of the forward flange 25 of I-beam 24, at the point where the I-beam 24 is welded to the foot plate 20. The extension 84 is shaped to cover and retain the foot plate 20 to minimize tipping movement of the turntable 80. An optional, removable handle 86 can be attached to the turntable 80 for assistance in rotating the turntable 80 between splits, as shown by arrow C.

Referring to FIG. 5*a*, to operate the turntable embodiment, the person(s) splitting logs would: (1) hydraulically lower the wedge 14 (by manual lowering of the control valve handle 28) to the desired point where there is sufficient slack in the cable 66 and chain 8 to reach the center of a log section 38; (2) pound the dog 10 into the center of the log section; (3) hydraulically lift the wedge 14 until the log section is elevated; (4) swing the log section into position over the turntable 80; (5) hydraulically lower the wedge 14 to lower the log section 38 onto the turntable 80 so that the log section 38 is centered and resting on the turntable 80; (6) further hydraulically lower the wedge 14 to effect a radial split; (7) hydraulically raise the wedge 14; (8) manually (e.g. by use of a handle 86 on the turntable 80) rotate the turntable 80 so that the log section 38 is rotated to a desirable position for the next radial split; (9) hydraulically lower the wedge 14 to effect the next split; (10) repeat steps 7 through 9 until the large log is completely split to the desired size wedge-shaped pieces. Alternately, the person splitting the log could manually lift the log section 38 onto the turntable 80 (without the use of the inventive block hoist as described in Steps 1 through 5) and proceed with the splitting as described in Steps 6 through 9.

Figures 6A, 6B:
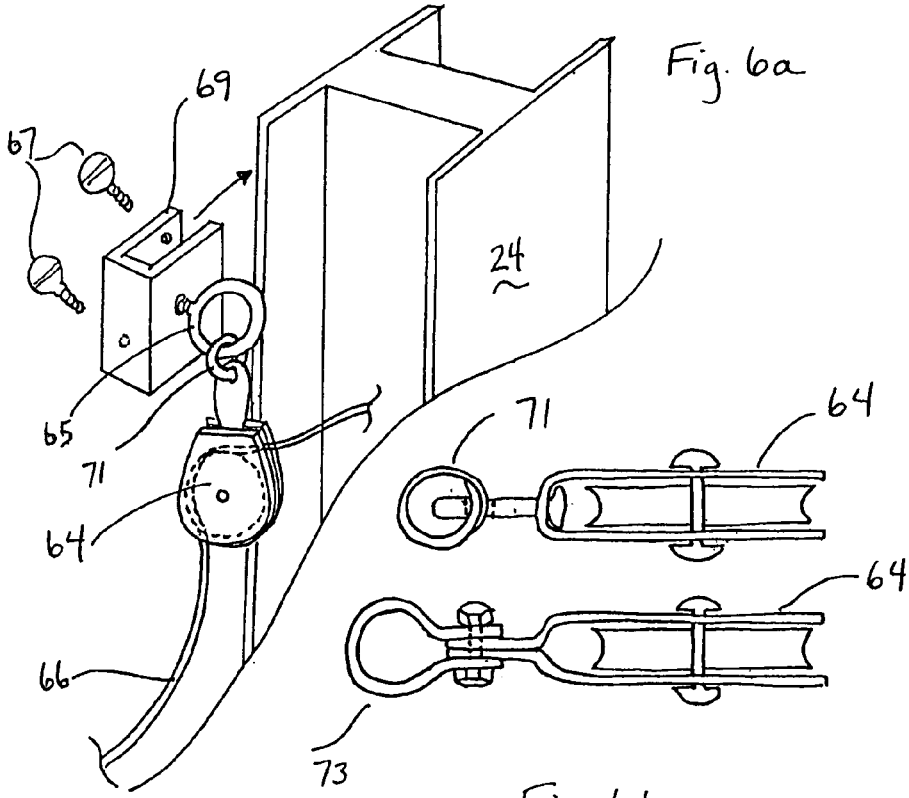
FIG. 6*a* is an isometric view of an alternative embodiment showing a U-channel eye clamp assembly on which to secure a pulley.
FIG. 6*b* shows two alternative pulley assemblies; a split ring and a C-eye.

FIG. 6*a* shows an alternative pulley-securing bracket embodiment in which a section of U-shaped metal channel 69 is drilled with one or more holes on the outside face and one hole on the inside face to correspond with two thumb screws 67 and one eye 65. The pulley 64 is secured to eye 65 by ring 71. Thumb screws 67 are used to tighten the U-shaped channel 69 onto the I-beam 24.

FIG. 6*b* shows two embodiments for fastening pulleys 64 to the inventive block hoist in the variety of bracket embodiments shown in FIGS. 1, 2, 3, 4 and 6. The upper drawing illustrates a split ring 71; the lower is a C-eye 73.

FIG. 7*a* illustrates an embodiment of the boom assembly 4 in which the upper pulley bracket assembly 70 is affixed to the boom tube 54 by a lateral extension. A bolt 72 passes through a washer 77, the pulley flange 64, a second washer 77, a spacer 79 and then through the boom tube 54. At the back of the boom tube 54, the bolt 72 is secured by a third washer 77 and a nut 81. This assembly allows the pulley 64 to swing front to back as tension varies during movement of the cable system and to laterally clear the hydraulic cylinder and wedge.

Figure 7B:
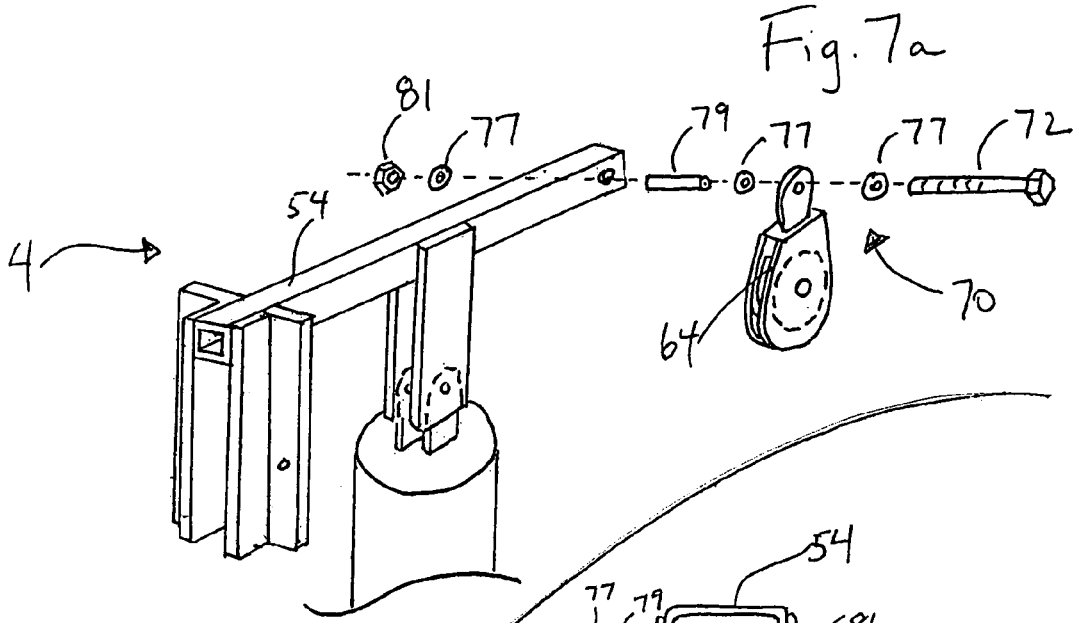
FIG. 7*b* is a front elevation of the boom assembly, showing the boom tube to which the pulley assembly is mounted.
Figure 7B:
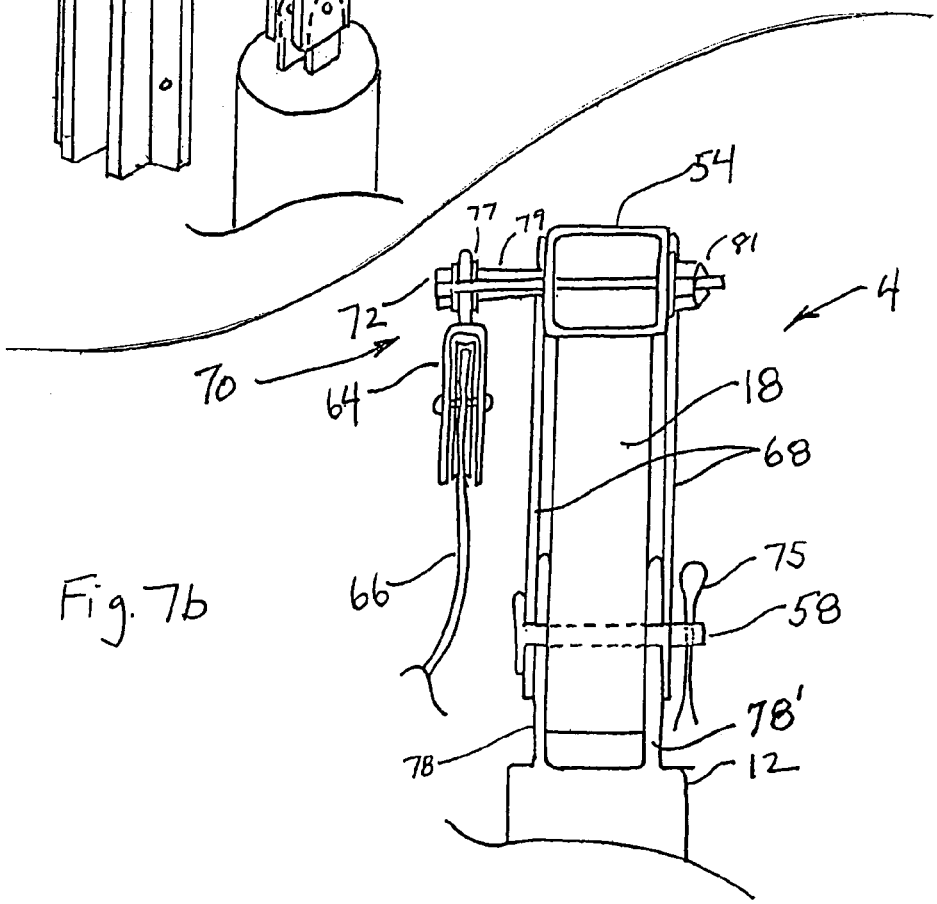

FIG. 7*b* shows the square boom tube 54 at the top, and the cylinder mounting plates 68 secured to the hydraulic cylinder 12, via the pin 58 inserted through holes 56 in the opposed boom plates 68, cylinder mounting plates 78, 78' and a corresponding hole in the hydraulic mounting block 18. The assembly is securely fastened with a cotter pin 75.

INDUSTRIAL APPLICABILITY

It is clear that the inventive block hoist of this application has wide applicability to the log splitting industry, namely to fitting existing hydraulic-powered log splitters for lifting, maneuvering, and cutting of larger logs. Before the inventive log hoist, home and light industrial-sized splitters were ordinarily not used for splitting large logs (15"–20" to 40" in diameter). They would either have to be split laboriously by hand or sent to mills or heavy industrial sites. This invention expands the range of log sizes that these smaller, portable log splitters can handle.

In addition, the inventive block hoist can be easily made of off-the-shelf components, e.g., cable, pulleys, square iron rods, conventional chain, dog, and fasteners. Thus the inventive block hoist has the clear potential of becoming adopted as the new standard for apparatus and methods of lifting and positioning large logs onto conventional hydraulic-powered log splitters.

It should be understood that various modifications within the scope of this invention can be made by one of ordinary skill in the art without departing from the spirit thereof and without undue experimentation. For example, the block hoist can be used in connection with a retrofitted foot plate (turntable) for easier rotation of the log between cuts. Conversely, the turntable could be utilized without the block hoist. In addition, the cable and pulley system can have a wide range of designs to provide the functionalities disclosed herein. This invention is therefore to be defined as broadly as the prior art will permit, and in view of the specification if need be, including a full range of current and future equivalents thereof.

Parts List: This is provided as an aid to examination, and may be cancelled upon allowance.

2 hydraulic-powered wood splitting unit fitted with inventive block hoist assembly
4 boom/bracket assembly
6 cable and pulley system
8 adjustable chain
10 dog/spike/auger
12 hydraulic cylinder
14 splitter wedge
16 piston rod
18 hydraulic mounting block
20 foot plate
22 wedge slide assembly
23 metal brackets
24 I-beam
25 Front flange of the I-beam
26 hydraulic hose/line
28 control valve handle
30 gas engine
32 transport chassis
34 wheels
36 sheath
38 log section
40 pump
50 cable bracket/anchor assembly
54 boom tube
56 hole for pin
58 pin
60 hydraulic fluid
62 angle iron
64 pulley
65 eye
66 cable
67 thumb screw
68 boom pin plates
69 U-channel clamp eye assembly
70 pulley bracket
71 split ring
72 bolt
73 C-eye
74 welds
75 Cotter pin
76 log section
77 washer
78 cylinder mounting plates
79 spacer
80 turntable plate
81 nut
82 pivot pin (bolt)
84 extension sheath
86 optional handle
A Cable threading path
B Arc of swinging log
C Turntable rotation

What is claimed is:

1. In a log splitter comprising a guide beam having a head end and a foot end, a movable splitting wedge assembly mounted to reciprocatingly slide on said guide beam, a powered ram assembly connected to said wedge, said ram moving said wedge in a splitting stroke from a first, retracted ready position medial of said guide beam ends which permits placement of a log section in position to be split by said ram, to a second, extended split position adjacent said foot end, the improvement which comprises:

a) a boom assembly secured in association with said guide beam adjacent said head end thereof, said boom having at least one, first pulley for guiding a log section lifting cable;

b) a second pulley secured adjacent the foot end of said guide beam;

c) an anchor point disposed in association with said splitting wedge assembly;

d) a cable having one end secured to said anchor point at said splitting wedge that is threaded sequentially through said second and said first pulley, and terminating in an attaching member to which a log-securing chain or cable may be hooked; and e) so that when a log is secured to said log-securing chain or cable, said ram power lifts said log upon retraction to said first, ready position permitting said log to be positioned to be split by said wedge.

2. A log splitter as in claim 1 wherein said ram is hydraulically powered and said guide beam is selectively orientable between a horizontal and a vertical position.

3. A log splitter as in claim 1 wherein said first pulley is located adjacent a forward end of said boom assembly, and which includes a second pulley located adjacent a back end of said boom assembly to assist in guiding said cable between said first pulley and said anchor point on said splitting wedge.

4. A log splitter as in claim 1 which includes a footplate disposed projecting from the foot end of said guide beam as a surface onto which log sections are positioned for splitting.

5. A log splitter as in claim 4 which includes a turntable assembly removably securable to said footplate on which large diameter or heavy logs are positionable by said lifting chain or cable, and rotated for effecting multiple splits in said logs.

6. A log splitter as in claim 1 which includes wheels for portability.

7. An accessory kit of a power log splitter comprising a guide beam having a head end and a foot end, a movable splitting wedge assembly mounted to reciprocatingly slide on said guide beam, a powered ram assembly connected to said wedge, said ram moving said wedge in a splitting stroke from a first, retracted ready position medial of said guide beam ends which permits placement of a log section in position to be split by said ram, to a second, extended split position adjacent said foot end, said kit further comprising:

a) a boom assembly configured to fit and be securable in association with said guide beam adjacent said head end thereof, said boom having at least one, first pulley for guiding a log section lifting cable;

b) a second pulley securable adjacent the foot end of said guide beam;

c) an anchor member securable in association with and to be movable by said splitting wedge assembly;

d) a cable having one end securable to said anchor member at said splitting wedge that is threaded sequentially through said second and said first pulley, and terminating in an attaching member to which a log-securing chain or cable may be hooked;

e) fasteners for securing said boom assembly to said splitter adjacent the head end of said guide beam and for securing said second pulley to said splitter adjacent said foot end; and f) so that when a log is secured to said log-securing chain or cable, said ram power lifts said log upon retraction to said first, ready position permitting said log to be positioned to be split by said wedge.

8. An accessory kit for a log splitter as in claim 7 which includes a chain and dog for attaching the log sections to the cable.

9. An accessory kit for a power log splitter as in claim 7 wherein said anchor member comprises an anchor bracket to which said cable is secured, and at least one fastener for securing said anchor bracket in association with said wedge.

10. An accessory kit for a log splitter as in claim 7 wherein said first pulley is located adjacent a forward end of said boom assembly, and which kit includes a second pulley located adjacent a back end of said boom assembly to assist in guiding said cable between said first pulley and said anchor member on said splitting wedge.

11. An accessory kit for a log splitter as in claim 7 wherein said guide beam terminates at its foot end in a footplate, and which kit includes a turntable assembly removably securable to said footplate on which large diameter or heavy logs are positionable by said lifting chain or cable, and rotated for effecting multiple splits in said logs.

12. A power log splitter comprising in operative combination:

a) a guide beam having a head end and a foot end;

b) a movable splitting wedge assembly mounted to reciprocatingly slide on said guide beam;

c) a powered ram assembly connected to said wedge, said ram moving said wedge in a splitting stroke from a first, retracted ready position medial of said guide beam ends which permits placement of a log section in position to be split by said ram, to a second, extended split position adjacent said foot end;

d) said guide beam includes a boom assembly disposed adjacent said head end thereof, said boom having at least one, first pulley for guiding a log section lifting cable;

e) a second pulley secured adjacent the foot end of said guide beam;

f) a cable having one end secured in association with said splitting wedge assembly that is threaded sequentially through said second and said first pulley, and terminating in an attaching member to which a log-securing chain or cable may be hooked; and g) so that when a log is secured to said log-securing chain or cable, said ram lifts said log upon retraction to said first, ready position permitting said log to be positioned to be split by said wedge.

13. A log splitter as in claim 12 wherein said ram is hydraulically powered and said guide beam is selectively positionable between a horizontal and a vertical position.

14. A log splitter as in claim 12 wherein said first pulley is located adjacent a forward end of said boom assembly, and which includes a second pulley located adjacent a back end of said boom assembly to assist in guiding said cable between said first pulley and said anchor point on the splitting wedge.

15. A log splitter as in claim 12 which includes a footplate disposed projecting from the foot end of the guide beam as a surface onto which log sections are positioned for splitting.

16. A log splitter as in claim 15 which includes a turntable assembly removably securable to said footplate on which large diameter or heavy logs are positionable by said lifting chain or cable, and rotated for effecting multiple splits in said logs.

17. A log splitter as in claim 12 which includes wheels for portability.

* * * * *